United States Patent [19]

Villanyi

[11] 4,280,077

[45] Jul. 21, 1981

[54] CATHODE-RAY TUBE HAVING CORRUGATED SHADOW MASK WITH VARYING WAVEFORM

[75] Inventor: Sigmund T. Villanyi, Lancaster, Pa.

[73] Assignee: RCA Corporation, New York, N.Y.

[21] Appl. No.: 904,778

[22] Filed: May 11, 1978

[51] Int. Cl.[3] ..... H01J 29/07

[52] U.S. Cl. ..... 313/402; 313/403; 313/408

[58] Field of Search ..... 313/403, 402, 404, 407, 313/408

[56] References Cited

U.S. PATENT DOCUMENTS

| | | | |
|---|---|---|---|
| 3,109,117 | 10/1963 | Kaplan | 313/408 |
| 3,872,345 | 3/1975 | Yamazaki et al. | 313/403 |
| 3,944,867 | 3/1976 | Kaplan | 313/403 |
| 4,072,876 | 2/1978 | Morrell | 313/403 |
| 4,122,368 | 10/1978 | Masterson | 313/407 X |

*Primary Examiner*—Palmer C. Demeo

*Attorney, Agent, or Firm*—Eugene M. Whitacre; Glenn H. Bruestle; Dennis H. Irlbeck

[57] ABSTRACT

A shadow mask type of cathode-ray tube is improved by including a corrugated mask having a cross-section of varying waveform. In one embodiment, the amplitude of the corrugations is gradually decreased in the center-to-edge directions whereas in another emdodiment the peak-to-peak wavelength between corrugations is increased in the center-to-edge directions. The amplitude and wavelength variations can also be combined in mask construction to obtain the advantages of each.

9 Claims, 5 Drawing Figures

CATHODE-RAY TUBE HAVING CORRUGATED SHADOW MASK WITH VARYING WAVEFORM

BACKGROUND OF THE INVENTION

This invention relates to shadow mask type cathode ray tubes and, particularly to contours of shadow masks within such tubes.

In a shadow mask tube, a plurality of convergent electron beams are projected through a multi-apertured color selection shadow mask to a mosaic screen. The beam paths are such that each beam impinges upon and excites only one kind of color-emitting phosphor on the screen. Generally, the shadow mask is attached to a rigid frame, which in turn, is suspended within the picture tube envelope.

Presently, all commercial color picture tubes have front or viewing faceplates that are either domed or cylindrical. However, it is desirable to develop a tube having a generally flat faceplate. There are problems that must be solved before a tube having a flat faceplate is commercially feasible. A major problem involves the shadow mask. According to prior art tube design concepts, in tubes having curved faceplates, the shadow mask is similarly curved so that it somewhat parallels the faceplate contour. Thus, in keeping with these prior art concepts, in a tube with a flat faceplate, the corresponding shadow mask should also have an almost flat contour. However, such a mask has insufficient self-supporting strength or rigidity. One way to provide this strength or ridigity would be to put the mask under tension as is done in some commercially available tubes having cylindrical faceplates. However, tension methods require undesirably expensive frame structures. Another way of providing strength to the mask is to give it some degree of contour such as by corrugating it, as suggested in U.S. Pat. No. 4,072,876 issued to A. M. Morrell on Feb. 7, 1978. It has been found, however, that a regular corrugated shape with a substantially sine wave cross section may be somewhat less than an optimum contour. For example, in a tube having a corrugated mask, aperture-to-aperture spacing and aperture width vary as functions of both mask-to-screen spacing and the relative angle formed between the electron beams and the mask. The required variations in aperture width create substantial problems in etching apertures into the mask. Since the required variations will be greatest at the edges of the mask, it is desirable to either decrease the mask-to-screen variations or decrease the beam-mask angle at these edges. The present invention therefore provides differing shadow mask contours that may be utilized to solve or at least reduce the foregoing and other various problems occurring in tubes with substantially flat faceplates.

SUMMARY OF THE INVENTION

A shadow mask type of cathode-ray tube is improved by including a corrugated mask having a cross-section of varying waveform. In one embodiment, the amplitude of the corrugations is gradually decreased in the center-to-edge directions. In another embodiment the peak-to-peak wavelength between corrugations is increased in the center-to-edge directions. The amplitude and wavelength variations can also be combined in mask construction to obtain the advantages of each.

DESCRIPTION OF THE PREFERRED EMBODIMENTS

Figure 1:
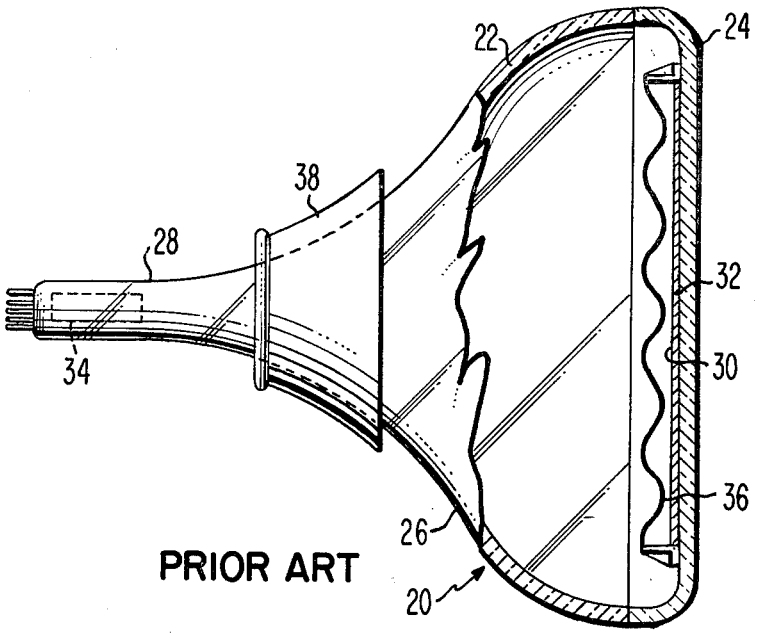
FIG. 1 is a partially cut-away top view of a prior art cathode ray tube.

FIG. 1 illustrates a prior art apertured-mask color television picture tube 20, such as disclosed in U.S. Pat. No. 4,072,876, comprising an evacuated glass envelope 22. The envelope 22 includes a rectangularly-shaped flat faceplate panel 24, a funnel 26, and a neck 28. A three-color phosphor viewing-screen 30 is supported on the inner surface 32 of the faceplate panel 24. An electron-gun assembly 34, positioned in the neck 28, includes three electron guns (not shown), one for each of the three color phosphors on the viewing-screen 30. A rectangular apertured mask 36 is positioned in the envelope 22 adjacent the viewing screen 30. The electron gun assembly 34 is adapted to project three electron beams through the apertured mask 36 to strike the viewing-screen structure 30 with the mask 36 serving as a color selection electrode. A magnetic deflection yoke 38 is positioned on the envelope 22 near the intersection of the funnel 26 and the neck 28. When suitably energized, the yoke 38 causes the electron beams to scan the screen 30 in a rectangular raster.

Figure 2:
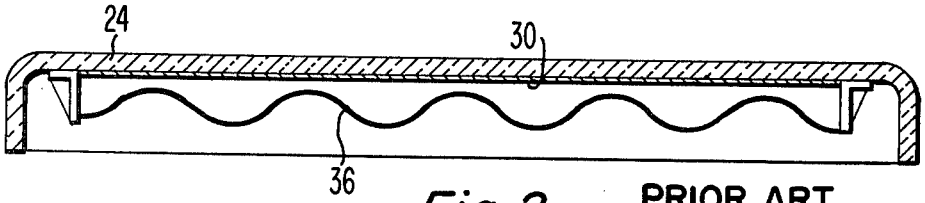
Fig. 2 PRIOR ART
FIG. 2 is a sectional side view of a prior art tube faceplate having a sinusoidal-shaped apertured mask mounted therein.

The apertured mask 36 of FIGS. 1 and 2 is corrugated or somewhat sinusoidally curved along the horizontal axis (in the direction of the larger dimension of the mask) with the corrugations extending vertically (between long sides of the mask or in the direction of the shorter dimension of the mask). The mask 36 has a plurality of elongated apertures aligned in parallel vertical columns (in the direction of the shorter mask dimension). The column-to-column spacing is varied with respect to the mask-to-screen spacing so that the phosphor elements on the screen are evenly positioned with respect to each other.

Figure 3:
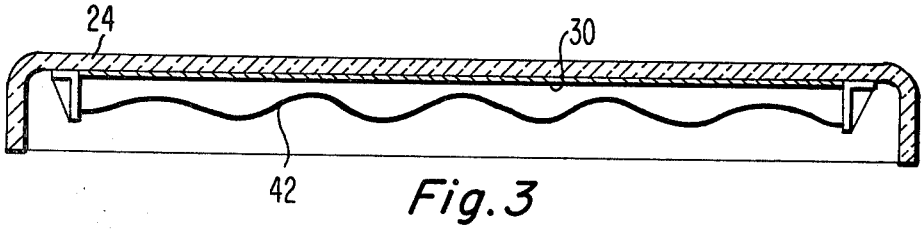
FIGS. 3–5 are sectional side views of tube faceplates having various apertured masks constructed in accordance with the present invention mounted therein.
Figure 4:
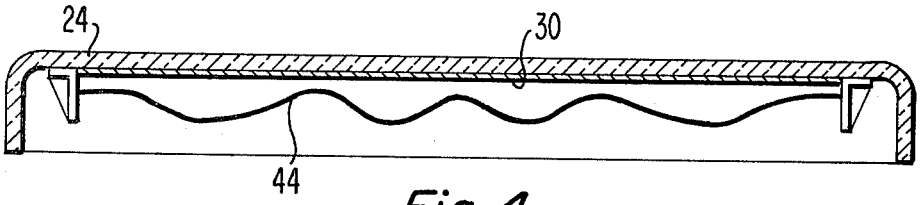
Figure 5:
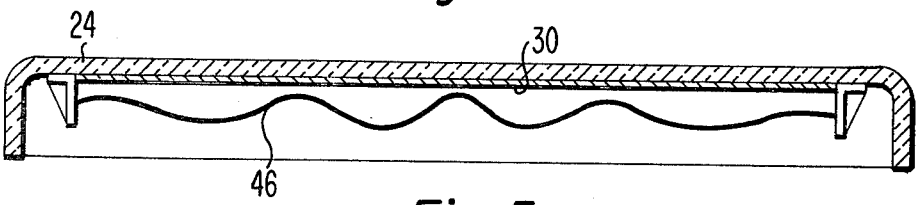

The present invention improves on the foregoing corrugated waveform mask concept by providing variations in the corrugation amplitude and/or corrugation wavelength. Some embodiments incorporating variations from a uniformly sinusoidally curved mask are illustrated in FIGS. 3 to 5. In each of these embodiments, the cross-sectional contour or waveform of a corrugated mask is varied to meet specific tube requirements. For purpose of simplification, the faceplates and mask supports of each embodiment are labeled with the same numerical designations.

In the embodiment of FIG. 3, the amplitude of corrugations in a mask 42 decreases from the center to the edge of the mask. Such mask configuration can be used where the rigidity requirements of the sides of the mask are less than in the center of the mask. For example, the sides of the mask may be held rigidly by a strong or flexible dynamically stiff frame thereby reducing the need for corrugation amplitude to obtain static and dynamic rigidity.

The simplification or smoothing of the mask waveform near the two side edges of the mask reduces the requirements of aperture spacing and aperture width.

For example, the angle of incidence between an electron beam and a portion of the corrugated mask extending away from the beam can be very narrow. Because of this, the apertures must be spaced further apart but must be wider than at a portion of the mask which is more perpendicular to the beam. Because of this variation, the tolerances required of the photographic artwork used in forming the mask and tolerances required of the etching equipment become very severe. Smoothing of the corrugated waveform reduces the variations in the beam-mask angle of incidence and therefore reduces the criticality of tolerances in the artwork and etching process.

Alternately, similar advantages can be obtained by increasing the wavelength of corrugations from the center to the sides of the mask as embodiments shown by the illustrated mask 44 of FIG. 4, wherein such wavelength lengthening also smooths out the corrugated mask contour at its edges. These two concepts of decreasing amplitude and increasing wavelength in the center-to-edge direction may also be combined. Such a combined waveform is shown as the mask 46 in FIG. 5.

What I claim is:

1. In an apertured shadow mask type cathode-ray tube, comprising an evacuated envelope including a faceplate, a phosphor viewing screen located on an inner surface of said faceplate, a multiapertured shadow mask mounted adjacent to said screen, and means for generating and projecting electrons along a plurality of convergent paths through said mask and to said screen, the improvement comprising, a shadow mask including a corrugated cross-section having a varying waveform wherein the cross-sectional contour of said mask at the edge of said mask is different than the cross-sectional contour at the center of said mask.

2. The tube as defined in claim 1 wherein the amplitude of corrugations varies across the mask.

3. The tube as defined in claim 1 wherein the wavelength of corrugations varies across the mask.

4. The tube as defined in claim 1 wherein both the amplitude and wavelength of corrugations vary across the mask.

5. In an apertured shadow mask type cathode-ray tube comprising an evacuated envelope including a substantially flat faceplate, a phosphor viewing screen located on an inner surface of said faceplate, a multiapertured shadow mask mounted adjacent to said screen, and means for generating and projecting electrons along a plurality of convergent paths through said mask and to said screen, the improvement comprising a shadow mask having a corrugated cross-sectional contour wherein the amplitude of corrugations varies from the center to edge of the mask.

6. The tube as defined in claim 5, wherein the amplitude of corrugations decreases from the center to the edge of the mask.

7. In an apertured shadow mask type cathode-ray tube comprising an evacuated envelope including a substantially flat faceplate, a phosphor viewing screen located on an inner surface of said faceplate, a multiapertured shadow mask mounted adjacent to said screen, and means for generating and projecting electrons along a plurality of convergent paths through said mask and to said screen, the improvement comprising a shadow mask having a corrugated cross-sectional contour wherein the wavelength of corrugations varies from the center to the edge of the mask.

8. The tube as defined in claim 7 wherein the wavelength of corrugations increases from the center to the edge of the mask.

9. In an apertured shadow mask type cathode-ray tube, comprising an evacuated envelope including a substantially flat faceplate, a phosphor viewing screen located on an inner surface of said faceplate, a multiapertured shadow mask mounted adjacent to said screen and means for generating and projecting electrons along a plurality of convergent paths through said mask and to said screen, the improvement comprising a shadow mask having a corrugated cross-sectional contour wherein both the amplitude and the wavelength of corrugations vary from the center to the edge of the mask.

* * * * *